US010119367B2

(12) United States Patent
Pawar et al.

(10) Patent No.: US 10,119,367 B2
(45) Date of Patent: Nov. 6, 2018

(54) WELLBORE REVERSE CIRCULATION WITH FLOW-ACTIVATED MOTOR

(71) Applicant: Halliburton Energy Services, Inc., Houston, TX (US)

(72) Inventors: Bharat Bajirao Pawar, Duncan, OK (US); Amr Z. El-Farran, Cairo (EG); Giuseppe Ambrosi, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 187 days.

(21) Appl. No.: 15/112,017

(22) PCT Filed: Sep. 29, 2015

(86) PCT No.: PCT/US2015/052787

§ 371 (c)(1),
(2) Date: Jul. 15, 2016

(87) PCT Pub. No.: WO2017/058151

PCT Pub. Date: Apr. 6, 2017

(65) Prior Publication Data

US 2017/0234112 A1 Aug. 17, 2017

(51) Int. Cl.
*E21B 37/00* (2006.01)
*E21B 21/00* (2006.01)
(Continued)

(52) U.S. Cl.
CPC ..... *E21B 37/00* (2013.01); *E21B 4/02* (2013.01); *E21B 10/62* (2013.01); *E21B 21/00* (2013.01); *E21B 2021/006* (2013.01)

(58) Field of Classification Search
CPC ..... E21B 21/00; E21B 37/00
See application file for complete search history.

(56) References Cited

U.S. PATENT DOCUMENTS 3,362,488 A * 1/1968 Ioanesyan ..... E21B 4/02 175/107
3,602,303 A * 8/1971 Blenkarn ..... E21B 33/035 166/360

(Continued)

FOREIGN PATENT DOCUMENTS

WO 2007014465 A1 2/2007

OTHER PUBLICATIONS

ISR/WO for PCT/US2015/052787 dated Jun. 9, 2016.

*Primary Examiner* — Shane Bomar
(74) *Attorney, Agent, or Firm* — Alan Bryson; Tumey L.L.P.

(57) ABSTRACT

A well system includes a work string extendable into a wellbore, and a pump that pumps a fluid into an annulus defined between the work string and the wellbore. A flow-activated motor is coupled to the work string and has a housing that receives the fluid pumped into the annulus. The flow-activated motor further includes a driveshaft rotatably positioned within the housing and a plurality of rotor vanes coupled to the driveshaft, wherein the driveshaft rotates as the fluid flows through the housing and impinges on the plurality of rotor vanes. A rotating agitator tool is coupled to the driveshaft such that rotation of the driveshaft correspondingly rotates the rotating agitator tool. The rotating agitator tool engages and loosens debris in the wellbore while rotating, and the debris is entrained in the fluid and flows through the flow-activated motor and subsequently to a surface location for processing.

16 Claims, 2 Drawing Sheets

(51) Int. Cl.
*E21B 4/02* (2006.01)
*E21B 10/62* (2006.01)

(56) References Cited

U.S. PATENT DOCUMENTS

| | | | | | |
|---|---|---|---|---|---|
| 4,223,747 | A | | 9/1980 | Marais | |
| 4,282,941 | A | * | 8/1981 | Perkin | E21B 10/345 175/267 |
| 4,436,168 | A | * | 3/1984 | Dismukes | E21B 4/00 173/217 |
| 4,747,452 | A | | 5/1988 | Clark | |
| 5,033,545 | A | | 7/1991 | Sudol | |
| 5,186,265 | A | * | 2/1993 | Henson | E21B 4/02 175/107 |
| 5,447,200 | A | * | 9/1995 | Dedora | E21B 17/1057 166/105 |
| 5,586,609 | A | | 12/1996 | Schuh | |
| 6,892,829 | B2 | | 5/2005 | Livingstone | |
| 7,055,627 | B2 | | 6/2006 | Fontana et al. | |
| 7,066,283 | B2 | | 6/2006 | Livingstone | |
| 7,090,018 | B2 | | 8/2006 | Livingstone | |
| 7,204,327 | B2 | | 4/2007 | Livingstone | |
| 8,833,490 | B2 | | 9/2014 | Johnson | |
| 9,022,146 | B2 | | 5/2015 | Krueger et al. | |
| 2003/0056990 | A1 | * | 3/2003 | Oglesby | E21B 4/003 175/57 |
| 2010/0147591 | A1 | | 6/2010 | Pomerleau et al. | |
| 2013/0112482 | A1 | | 5/2013 | Armistead et al. | |
| 2014/0102802 | A1 | * | 4/2014 | Kolle | E21B 4/006 175/71 |
| 2014/0202767 | A1 | * | 7/2014 | Feasey | E21B 21/08 175/57 |
| 2015/0027781 | A1 | | 1/2015 | Vestavik et al. | |
| 2015/0136492 | A1 | | 5/2015 | Speer et al. | |

* cited by examiner

WELLBORE REVERSE CIRCULATION WITH FLOW-ACTIVATED MOTOR

BACKGROUND

Wellbores in the oil and gas industry are generally drilled by rotating a drill bit conveyed into the wellbore as attached to a drill string. A bottom hole assembly (BHA) is positioned near the end of the drill string and includes the drill bit. The drill string can include multiple lengths of drill pipe or tubing, or may alternatively comprise coiled tubing. In some cases, the drilling assembly includes a drilling motor or a "mud motor" that rotates the drill bit. In other cases, the drill bit may be rotated by rotating the entire drill string from a surface drilling rig.

During drilling, a drilling fluid or "mud" is supplied, often pumped under pressure, from a source at the surface into the drill string. When a drilling motor is used, the drilling fluid drives the drilling motor and then discharges at the bottom of the drill bit. The drilling fluid returns uphole via the annulus defined between the drill string and the wellbore and carries with it cuttings and debris generated by the drill bit while drilling the wellbore.

At various times while drilling or completing a wellbore, the drilling fluid may be reverse circulated through the wellbore in an attempt to clean out the wellbore. For example, reverse circulation is commonly employed for sand cleanout purposes following wellbore fracturing or hydrajetting operations. In reverse circulation, a surface pump used to circulate the drilling fluid through the drill string and into the surrounding annulus (i.e., forward circulation), is instead used to pump the drilling fluid first into the annulus and then into the drill string at a location at or near the bottom of the drill string. The return fluid flows up the drill string, carrying with it sand, debris, and drill cuttings.

Reverse circulation forces the drilling fluid to flow through the relatively smaller inner diameter of the drill string in returning to the surface as opposed to the larger annulus, and thus achieves better fluid velocity. The increased fluid velocity enhances the debris (sand) suspension capabilities of the drilling fluid as compared to direct (i.e., forward) circulation. More particularly, greater fluid velocity helps entrain and lift the debris more efficiently, which increases the overall cleaning efficiency or effectiveness of the operation for the well. This is true, however, only if the debris is suspended and loose within the wellbore. If the debris is consolidated and settled, reverse circulation may lose this advantage due to an inability to agitate the consolidated debris. While increasing the pressure differential of the reverse circulation may agitate some of the consolidated debris to be circulated out, such increased pressures may also result in damage to the drill string (coiled tubing) or in fluid losses into the subterranean formations surrounding the wellbore.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to downhole drilling systems and, more particularly, to systems and methods of reverse circulation in wellbores using a flow-activated motor.

Embodiments described herein provide a flow-activated motor operatively coupled to a rotating agitator tool to aid in cleaning a wellbore of settled debris or sand under reverse circulation conditions. As described herein, the flow-activated motor and the rotating agitator tool may be introduced into a wellbore on a work string. The flow-activated motor has a housing and a driveshaft rotatably positioned within the housing, and the rotating agitator tool is coupled to the driveshaft such that rotation of the driveshaft correspondingly rotates the rotating agitator tool. A fluid may be pumped into an annulus defined between the work string and the wellbore and may be received by the housing. As the fluid flows through the housing, it impinges on a plurality of rotor vanes coupled to the driveshaft and thereby rotates the driveshaft, which causes the rotating agitator tool, correspondingly, to rotate. As the rotating agitator tool rotates, it may engage and loosen the debris in the wellbore and the loosened debris may be entrained in the fluid and flow through the flow-activated motor with the fluid. Accordingly, reverse circulation of the fluid may drive the flow-activated motor and the rotating agitator tool, and may simultaneously help loosen and entrain consolidated debris in the wellbore.

Figure 1:
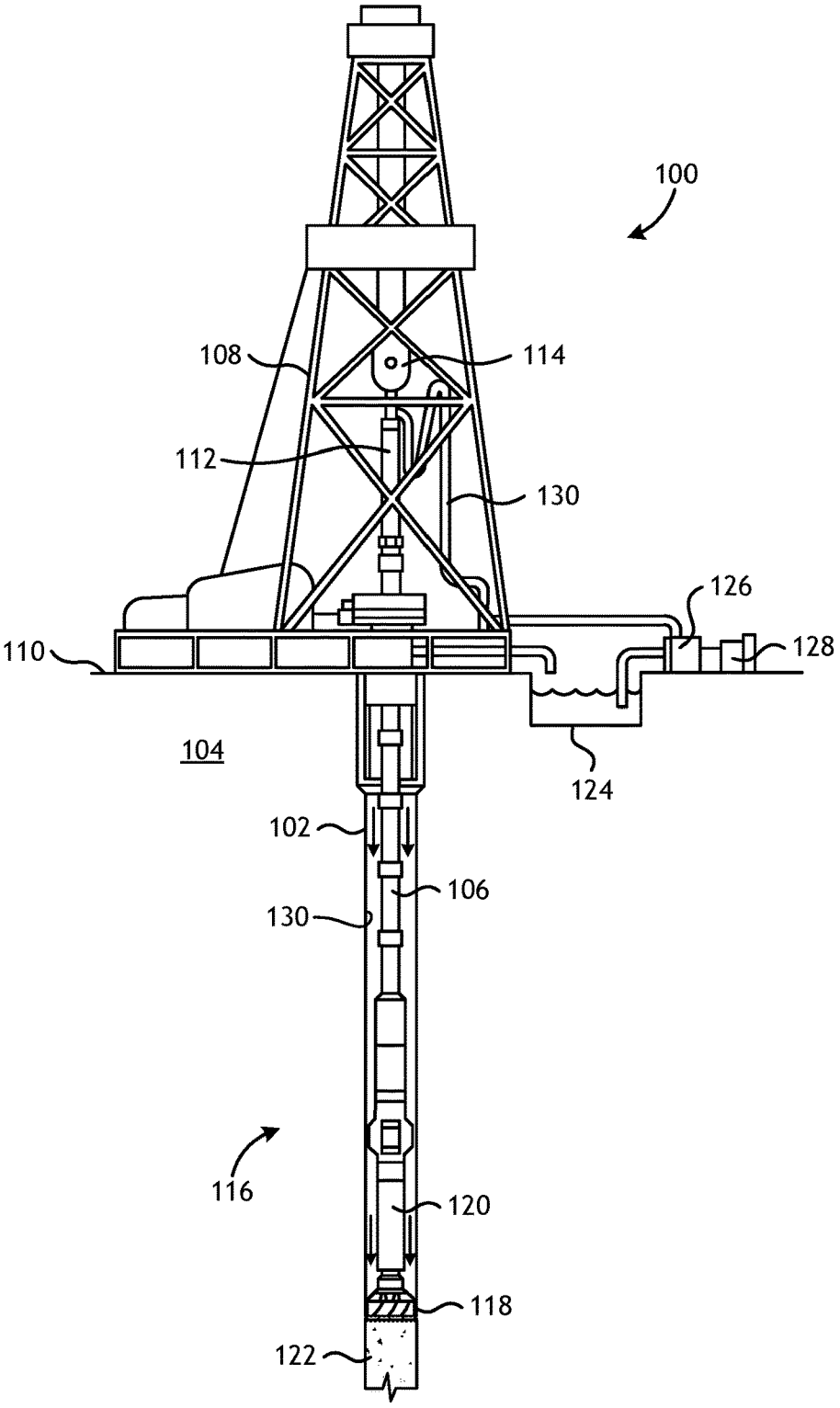
FIG. 1 illustrates a schematic diagram of an exemplary well system that may employ one or more principles of the present disclosure.

FIG. 1 illustrates a schematic diagram of an exemplary well system 100 that may employ one or more principles of the present disclosure. As illustrated, a wellbore 102 has been drilled into the earth 104 and a work string 106 is extended into the wellbore 102 from a surface rig 108. The surface rig 108 may comprise a derrick, for example, arranged at the surface 110 and includes a kelly 112 and a traveling block 114 used to lower and raise and lower the kelly 112 and the work string 106. In some embodiments, as illustrated, the work string 106 may comprise multiple lengths of drill pipe or tubing connected end to end. In other embodiments, however, the work string 106 may alternatively comprise coiled tubing. In such embodiments, the surface rig 108 may instead include a reel from which the coiled tubing is deployed into the wellbore 102.

Although the well system 100 is depicted as a land-based operation, the well system 100 may alternatively comprise an offshore operation. In such embodiments, the surface rig 108 may instead comprise a floater, a fixed platform, a gravity-based structure, a drill ship, a semi-submersible platform, a jack-up drilling rig, a tension-leg platform, and the like. It will be appreciated that embodiments of the disclosure can be applied to surface rigs 108 ranging anywhere from small in size and portable, to bulky and permanent. Further, although the well system 100 is described herein with respect to an oil and gas well, the principles of the present disclosure may equally be used in other applications or industries including, but not limited to, mineral exploration, environmental investigation, natural gas extraction, underground installation, mining operations, water wells, geothermal wells, and the like.

The work string 106 may include a bottom hole assembly (BHA) 116 coupled in-line with the work string 106 at or near the bottom thereof and able to move axially within the wellbore 102. Among several other downhole tools and sensors not described herein, the BHA 116 may include a rotating agitator tool 118 and a flow-activated motor 120 operatively coupled to the rotating agitator tool 118. The rotating agitator tool 118 may be coupled to the flow-activated motor 120 such that fluid flow through the interior of the flow-activated motor 120 results in rotation of the rotating agitator tool 118 about a central axis. The rotating agitator tool 118 may comprise a variety of known downhole cutting or milling tools including, but not limited to, a drill bit, a reamer, a hole opener, a mill, a scrapper, or any combination thereof.

In some embodiments, the work string 106 may be used to drill the wellbore 102 and subsequently used to clean out the wellbore 102. In other embodiments, however, the work string 106 may be lowered into the wellbore 102 following drilling operations to perform cleanout operations in the wellbore 102. Cleaning out the wellbore 102 may entail reverse circulating a fluid through the wellbore 102 to remove debris 122 that has settled at or near the bottom of the wellbore 102. The debris 122 may comprise, for example, sand or rock resulting from hydraulically fracturing the surrounding subterranean formations or from hydrajetting operations at particular points within the wellbore 102, but could also include drill cuttings or formation rubble resulting from wellbore drilling operations. The debris 122 may also include mud, cement damage, and scale that has settled at the bottom of the wellbore 102. Those skilled in the art may refer to the debris 122 as a "sand plug" or a "consolidated sand plug."

In reverse circulation, drilling fluid or "mud" from a mud tank 124 may be pumped downhole using a mud pump 126 powered by an adjacent power source, such as a prime mover or motor 128. The drilling fluid may be pumped into an annulus 130 defined between the work string 106 and the wall of the wellbore 102, as indicated by the arrows. The drilling fluid advances to the bottom of the wellbore 102 where it is received into the interior of the work string 106 via one or more flow ports defined in one or both of the rotating agitator tool 118 and the flow-activated motor 120. As the drilling fluid enters the work string 106 at the bottom of the wellbore 102, some of the debris 122 may be entrained in the drilling fluid and drawn into the work string 106. The drilling fluid and the entrained debris 122 may then return to the surface 110 inside the work string 106. At the surface 110, the drilling fluid and entrained debris 122 may flow through a standpipe 130, for example, which feeds the drilling fluid and entrained debris 122 back into the mud tank 124 for processing such that a cleaned drilling fluid can be returned downhole within the annulus 130.

According to embodiments of the present disclosure, the rotating agitator tool 118 and the flow-activated motor 120 may be used to more effectively remove the debris 122 from the wellbore 102 during reverse circulation, especially in cases where the debris 122 has compacted and consolidated over time such that reverse circulation by itself is unable to effectively entrain and remove the debris 122. As described in more detail below, drilling fluid flowing through the flow-activated motor 120 in reverse circulation may cause a driveshaft (not shown) to rotate. The driveshaft may be operatively coupled to the rotating agitator tool 118 such that rotation of the driveshaft correspondingly rotates the rotating agitator tool 118, and rotating the rotating agitator tool 118 while contacting the debris 122 helps to stir and loosen the debris 122 such that it can be more easily entrained in the drilling fluid and conveyed to the surface 110.

Figure 2:
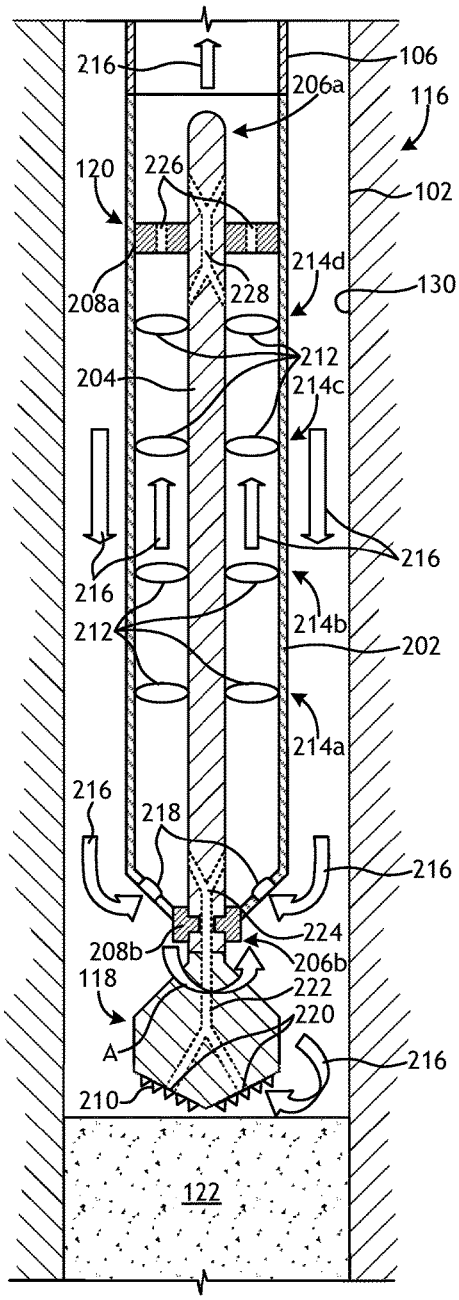
FIG. 2 is an enlarged partial cross-sectional view of a portion of the bottom hole assembly of FIG. 1.

FIG. 2 is an enlarged partial cross-sectional view of a portion of the BHA 116 of FIG. 1, according to one or more embodiments. As illustrated, the BHA 116 is positioned within the wellbore 102 and the debris 122 is shown as having settled, compacted, or otherwise consolidated at the bottom of the wellbore 102. The rotating agitator tool 118 and the flow-activated motor 120 are also shown as extended within the wellbore 102 and coupled to the work string 106. More particularly, the flow-activated motor 120 may include a housing 202 that may be directly or indirectly coupled to the work string 106, such as by a threaded engagement.

A driveshaft 204 may be rotatably positioned within the housing 202 and may have a first or upper end 206*a* and a second or lower end 206*b*. At or near the upper and lower ends 206*a,b*, the driveshaft 204 may be supported radially and/or axially by bearings 208, shown as an upper bearing assembly 208*a* and a lower bearing assembly 208*b*. The upper and lower bearing assemblies 208*a,b* may be configured to interpose the housing 202 and the driveshaft 204 and allow the driveshaft 204 to rotate with respect to the housing 202 along a longitudinal axis. The upper and lower bearing assemblies 208*a,b* may comprise radial bearings configured to radially support the driveshaft 204 in rotation. In some embodiments, one or both of the upper and lower bearing assemblies 208*a,b* may also include thrust bearings configured to axially support the driveshaft 204 and mitigate thrust loads assumed on the driveshaft 204 during operation.

In some embodiments, the upper and lower bearing assemblies 208*a,b* may further include one or more seals (not shown) that provide a sealed interface between the driveshaft 204 and the inner circumference of the bearing assemblies 208*a,b* another sealed interface between the inner wall of the housing 202 and the outer periphery of the bearing assemblies 208*a,b* at their respective locations.

The lower end 206*b* of the driveshaft 204 extends out of the housing 202 and may be directly or indirectly coupled to the rotating agitator tool 118. In one embodiment, for example, the driveshaft 204 may be directly coupled to the rotating agitator tool 118 via a threaded engagement. In other embodiments, however, a coupling (not shown) may interpose the driveshaft 204 and the rotating agitator tool 118 to operatively couple the two components. In either scenario, however, rotation of the driveshaft 204 in the direction indicated by the arrow A, will correspondingly cause the rotating agitator tool 118 to rotate in the same direction A. As will be appreciated, however, rotating agitator tool 118 may be operatively coupled to the driveshaft 204 in such a way that rotation of the driveshaft 204 in the direction A causes the agitator tool 118 to rotate in a direction opposite the direction A, without departing from the scope of the disclosure.

As illustrated, the rotating agitator tool 118 may include one or more cutting elements 210 arranged about the outer periphery thereof. While depicted as being positioned substantially along the bottom of the rotating agitator tool 118, the cutting elements 210 may also be positioned along the sides thereof, without departing from the scope of the disclosure. The cutting elements 210 may be configured to engage and stir (agitate) the debris 122 during operation. In some embodiments, the cutting elements 210 may comprise teeth or irregular (jagged) surfaces defined in the outer periphery of the rotating agitator tool 118. In other embodiments, however, the cutting elements 210 may comprise cutters commonly used in drill bits, such as polycrystalline diamond compact (PDC) cutters or roller cone cutters The flow-activated motor 120 may comprise, but is not limited to, a hydraulic motor, a vane motor, a turbine, a rotor-type motor, a stator-type motor, and any combination thereof. The flow-activated motor 120 may be configured to convert hydraulic energy from a circulating fluid into rotational energy used to rotate the rotating agitator tool 118. To accomplish this, the flow-activated motor 120 may include a plurality of rotor vanes 212 coupled to the driveshaft 204.

The rotor vanes 212 may be arranged in a plurality of stages 214, shown as a first stage 214*a*, a second stage 214*b*, a third stage 214*c*, and a fourth stage 214*d*. Each stage 214*a-d* may be axially offset from axially adjacent stages 214*a-d* and include a plurality of rotor vanes 212 arranged circumferentially about the driveshaft 204. While only four stages 214*a-d* are shown in FIG. 2, it will be appreciated that more (or less) than four stages 214*a-d* may be included in the flow-activated motor 120, without departing from the scope of the disclosure. Each rotor vane 212 may exhibit a profile configured to receive a flow of fluid (i.e., drilling fluid) and transfer hydraulic energy of the fluid to the driveshaft 204 in the form of rotational energy, which urges the driveshaft 204 to rotate.

While not shown, in some embodiments, the flow-activated motor 120 may further include a plurality of stator vanes and/or stages of stator vanes that axially interpose adjacent stages 214*a-d* of the rotor vanes 212. In such embodiments, the stator vanes may be coupled to the inner wall of the housing 202 and may be configured to receive the fluid discharged from an upstream or preceding stage 214*a-d* and redirect the fluid to a downstream or subsequent stage 214*a-d*. As will be appreciated, including the stator vanes may result in a more efficient flow-activated motor 120.

Figure 3:
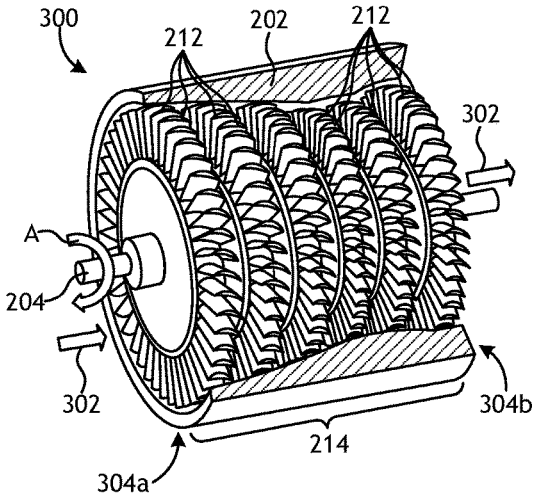
FIG. 3 is an isometric partial cross-sectional view of an exemplary flow-activated motor.

FIG. 3 is an isometric, partial cross-sectional view of an exemplary flow-activated motor 300, according to one or more embodiments. The flow-activated motor 300 may be the same as or similar to the flow-activated motor 120 of FIG. 2 and, therefore, may be coupled in-line with the work string 106 (FIGS. 1 and 2). As illustrated, the flow-activated motor 300 may include the driveshaft 204 rotatably mounted within the housing 202 and a plurality of rotor vanes 212 coupled to the driveshaft 204 in a corresponding plurality of stages 214 (six shown) axially spaced from each other along the driveshaft 204.

In exemplary operation of the flow-activated motor 300, a fluid 302 may enter the housing 202 at a first end 304*a*, flow through the housing 202, and exit at a second end 304*b*. As it flows through the housing 202, the fluid 302 impinges upon the rotor vanes 212 and progressively flows through each stage 214. The hydraulic energy of the fluid 302 is transferred to the rotor vanes 212, which impart rotational energy to the driveshaft 204 and thereby urge the driveshaft 204 to rotate in the direction A.

Referring again to FIG. 2, exemplary operation of the BHA 116 in cleaning the wellbore 102 is now provided, according to one or more embodiments. A fluid 216 is pumped into the annulus 130 defined between the inner wall of the wellbore 102 and the work string 106. As mentioned above, in some embodiments, the fluid 216 may comprise drilling fluid that originates from the mud tank 124 (FIG. 1) and may be pumped into the annulus 130 with the mud pump 126 (FIG. 1). In other embodiments, however, the fluid 216 may comprise fresh water, salt water, brine, acid, nitrogen, carbon dioxide, or any combination thereof.

Once reaching the bottom of the wellbore 102, the fluid 216 may enter the housing 202 of the flow-activated motor 120 and flow through the stages 214*a-d* of rotor vanes 212 in the uphole direction. In some embodiments, for instance, the fluid 216 may enter the housing 202 via one or more bullnose ports 218 (two shown) defined in the housing 202 at or near the second end 206*b* of the driveshaft 204. In other embodiments, or in addition thereto, the fluid 216 may enter the housing 202 via contiguous conduits defined in the rotating agitator tool 118 and the driveshaft 204. More particularly, the rotating agitator tool 118 may define one or more nozzle ports 220 (two shown) that extend through the body of the rotating agitator tool 118 and fluidly communicate with a central conduit 222. The central conduit 222 may fluidly communicate with a fluid conduit 224 defined in the driveshaft 204, and the fluid conduit 224 may feed the reverse circulating fluid 216 into the interior of the housing 202.

As the fluid 216 flows through the housing 202, the fluid 216 impinges upon the rotor vanes 212 as it progressively flows through each stage 214*a-d*. The profile of each rotor vane 212 receives the fluid 212 and transfers the hydraulic energy of the fluid 216 to the coupled driveshaft 204 in the form of rotational energy (torque), which urges the driveshaft 204 to rotate in the direction A. As the driveshaft 204 rotates, the rotating agitator tool 118 correspondingly rotates in the direction A and engages the debris 122 at the bottom of the wellbore 102. The rotational speed of the rotating agitator tool 118 may be controlled by controlling the pump rate of the fluid 216 in the annulus 130. For instance, an increased flow rate of fluid 216 through the flow-activated motor 120 will cause the driveshaft 204 to rotate at a higher velocity and correspondingly cause the rotating agitator tool 118 to rotate at a higher velocity.

While the rotating agitator tool 118 rotates, the cutting elements 210 of the rotating agitator tool 118 may engage and stir (agitate) the debris 122, thereby allowing the sand, cuttings, etc. of the debris 122 to be loosened and suspended in the fluid 216 so that the debris 122 can also flow into the housing 202 as entrained in the fluid 216. The work string 106 may be translated axially within the wellbore, such as from the surface rig 108 (FIG. 1), to locate and engage the debris 122. In some cases, the work string 106 may be reciprocated within the wellbore 102, which allows the rotating agitator tool 118 to alternatingly engage the debris 122.

After flowing through each stage 214*a-d*, the fluid 216 may exit the flow-activated motor 120 and may be conveyed to the surface 110 (FIG. 1) within the interior of the work string 106. In some embodiments, the fluid 216 may bypass the upper bearing assembly 208*a* by flowing through one or more flow ports 226 (two shown) defined through the upper bearing assembly 208*a* and thereby providing fluid communication between the interior of the housing 202 and the work string 106. In other embodiments, or in addition thereto, the fluid 216 may bypass the upper bearing assembly 208*a* by flowing through an exit conduit 228 defined in the driveshaft 204 and providing fluid communication between the interior of the housing 202 and the work string 106.

In some embodiments, one or more of the geometry, the size, and the number of the rotor vanes 212 may be altered to optimize operation of the flow-activated motor 120. For instance, the size and/or the number of rotor vanes 212 in each stage 214*a-d* may be configured to match the size of the rotating agitator tool 118. A larger rotating agitator tool 118 may require an increased number or size of rotor vanes 212 in order to accommodate adequate rotation of the rotating agitator tool 118. Moreover, in some embodiments, the number of stages 214*a-d* may also be altered to optimize operation of the flow-activated motor 120, without departing from the scope of the disclosure. In such embodiments, the length of the flow-activated motor 120 may correspondingly be altered to accommodate the increased or decreased number of stages 214*a-d*. As will be appreciated, altering the size and number of the rotor vanes 212 and/or the number of stages 214*a-d* will vary the torque generated during operation and transferred to the rotating agitator tool 118.

In order to prevent or otherwise reduce erosion resulting from the circulating fluid 216 and entrained debris 122 during operation, the rotor vanes 212 may be erosion-resistant. In some embodiments, for example, some or all of the rotor vanes 212 may be made of an erosion-resistant material. The erosion-resistant material may comprise, but is not limited to, a carbide (e.g., tungsten, titanium, tantalum, or vanadium), a carbide embedded in a matrix of cobalt or nickel by sintering, a cobalt alloy, a ceramic, a surface hardened metal (e.g., nitrided metals, heat-treated metals, carburized metals, hardened steel, etc.), a steel alloy (e.g. a nickel-chromium alloy, a molybdenum alloy, etc.), a cermet-based material, a metal matrix composite, a nanocrystalline metallic alloy, an amorphous alloy, a hard metallic alloy, or any combination thereof.

In other embodiments, however, some or all of the rotor vanes 212 may be made of a metal, such as stainless steel, and clad or coated with an erosion-resistant material, such as tungsten carbide, a cobalt alloy, or ceramic. In such embodiments, the rotor vanes 212 may be clad with the erosion-resistant material via any suitable process including, but not limited to, weld overlay, thermal spraying, laser beam cladding, electron beam cladding, vapor deposition (chemical, physical, etc.), any combination thereof, and the like. In yet other embodiments, the some or all of the rotor vanes 212 may be made of a material that has been surface hardened, such as surface hardened metals (e.g., via nitriding), heat treated metals (e.g., using 13 chrome), carburized metals, or the like.

Embodiments disclosed herein include:

A. A wellbore cleanout tool that includes a flow-activated motor having a housing, a driveshaft rotatably positioned within the housing, and a plurality of rotor vanes coupled to the driveshaft, wherein the driveshaft rotates as a fluid flows into and through the housing and impinges on the plurality of rotor vanes, and a rotating agitator tool coupled to the driveshaft such that rotation of the driveshaft correspondingly rotates the rotating agitator tool, wherein debris engaged by the rotating agitator tool while rotating is loosened and entrained in the fluid to flow through the flow-activated motor.

B. A method that includes introducing a work string into a wellbore, the work string including a flow-activated motor having a housing and a driveshaft rotatably positioned within the housing and a rotating agitator tool coupled to the driveshaft such that rotation of the driveshaft correspondingly rotates the rotating agitator tool, pumping a fluid into an annulus defined between the work string and the wellbore with a pump and receiving the fluid from the annulus in the housing, impinging the fluid on a plurality of rotor vanes coupled to the driveshaft and thereby rotating the driveshaft, rotating the rotating agitator tool and thereby engaging and loosening debris in the wellbore, and entraining the debris in the fluid and flowing the debris through the flow-activated motor with the fluid.

C. A well system that includes a work string extendable into a wellbore, a pump that pumps a fluid into an annulus defined between the work string and the wellbore, a flow-activated motor coupled to the work string and having a housing that receives the fluid pumped into the annulus, the flow-activated motor further including a driveshaft rotatably positioned within the housing and a plurality of rotor vanes coupled to the driveshaft, wherein the driveshaft rotates as the fluid flows through the housing and impinges on the plurality of rotor vanes, and a rotating agitator tool coupled to the driveshaft such that rotation of the driveshaft correspondingly rotates the rotating agitator tool, wherein the rotating agitator tool engages and loosens debris in the wellbore while rotating and the debris is entrained in the fluid and flows through the flow-activated motor.

Each of embodiments A, B, and C may have one or more of the following additional elements in any combination: Element 1: wherein the rotating agitator tool is a cutting tool selected from the group consisting of a drill bit, a reamer, a hole opener, a mill, a scrapper, and any combination thereof. Element 2: further comprising one or more cutting elements arranged about an outer periphery of the rotating agitator tool. Element 3: wherein the flow-activated motor is selected from the group consisting of a hydraulic motor, a vane motor, a turbine, a rotor-type motor, a stator-type motor, and any combination thereof. Element 4: further comprising one or more bearing assemblies interposing the driveshaft and the housing to support the driveshaft in rotation. Element 5: wherein the plurality of rotor vanes is arranged in a plurality of stages axially offset from each other along the driveshaft. Element 6: further comprising one or more bullnose ports defined in the housing to receive the fluid into the housing. Element 7: further comprising one or more nozzle ports defined in the rotating agitator tool, a central conduit defined in the rotating agitator tool that fluidly communicates with the one or more nozzle ports, and a fluid conduit defined in the driveshaft and fluidly communicable with the central conduit, wherein the fluid enters the housing by flowing through the one or more nozzle ports, the central conduit, and the fluid conduit. Element 8: wherein some or all of the plurality of rotor vanes is made of an erosion-resistant material. Element 9: wherein some or all of the plurality of rotor vanes is clad with an erosion-resistant material.

Element 10: wherein receiving the fluid from the annulus in the housing comprises receiving the fluid into the housing via one or more bullnose ports defined in the housing. Element 11: wherein receiving the fluid from the annulus in the housing comprises receiving the fluid at one or more nozzle ports defined in the rotating agitator tool, conveying the fluid from the one or more nozzle ports through a central conduit defined in the rotating agitator tool, and discharging the fluid into the housing via a fluid conduit defined in the driveshaft that fluidly communicates with the central conduit. Element 12: wherein impinging the fluid on the plurality of rotor vanes comprises impinging the fluid on a plurality of stages axially offset from each other along the driveshaft, wherein each stage includes rotor vanes arranged circumferentially about the driveshaft. Element 13: further comprising discharging the fluid and the debris entrained in the fluid from the flow-activated motor and into the work string, and conveying the fluid and the debris entrained in the fluid within the work string to a surface location. Element 14: further comprising altering at least one of the geometry, the size, and the number of the plurality of rotor vanes to optimize operation of the flow-activated motor.

Element 15: wherein the work string comprises one of drill pipe lengths connected end to end or coiled tubing. Element 16: further comprising one or more bullnose ports defined in the housing to receive the fluid into the housing. Element 17: further comprising one or more nozzle ports defined in the rotating agitator tool, a central conduit defined in the rotating agitator tool that fluidly communicates with the one or more nozzle ports, and a fluid conduit defined in the driveshaft and fluidly communicable with the central conduit, wherein the fluid enters the housing by flowing through the one or more nozzle ports, the central conduit, and the fluid conduit.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A wellbore cleanout tool, comprising:

a flow-activated motor having a housing, a driveshaft rotatably positioned within an interior of the housing, and a plurality of rotor vanes coupled to the driveshaft, wherein the driveshaft rotates as a fluid flows into and through the housing and impinges on the plurality of rotor vanes;

a rotating agitator tool coupled to the driveshaft such that rotation of the driveshaft correspondingly rotates the rotating agitator tool, wherein debris engaged by the rotating agitator tool while rotating is loosened and entrained in the fluid to flow through the flow-activated motor;

one or more bullnose ports defined in the housing to receive at least some of the fluid into the interior of the housing, the one or more bullnose ports being positioned axially between the rotating agitator tool and the plurality of rotor vanes;

one or more nozzle ports defined in the rotating agitator tool to receive at least some of the fluid; and a fluid conduit defined in the driveshaft to conduct the fluid from the one or more nozzle ports to the interior of the housing, the fluid conduit extending to a portion of the driveshaft that is axially between the one or more bullnose ports and the plurality of rotor vanes.

2. The wellbore cleanout tool of claim 1, wherein the rotating agitator tool is a cutting tool selected from the group consisting of a drill bit, a reamer, a hole opener, a mill, a scrapper, and any combination thereof.

3. The wellbore cleanout tool of claim 1, further comprising one or more cutting elements arranged about an outer periphery of the rotating agitator tool.

4. The wellbore cleanout tool of claim 1, wherein the flow-activated motor is selected from the group consisting of a hydraulic motor, a vane motor, a turbine, a rotor-type motor, a stator-type motor, and any combination thereof.

5. The wellbore cleanout tool of claim 1, further comprising one or more bearing assemblies interposing the driveshaft and the housing to support the driveshaft in rotation.

6. The wellbore cleanout tool of claim 1, wherein the plurality of rotor vanes is arranged in a plurality of stages axially offset from each other along the driveshaft.

7. The wellbore cleanout tool of claim 1, further comprising a central conduit defined in the rotating agitator tool that fluidly communicates with the one or more nozzle ports, wherein the fluid enters the housing by flowing through the one or more nozzle ports, the central conduit, and the fluid conduit.

8. The wellbore cleanout tool of claim 1, wherein some or all of the plurality of rotor vanes is made of an erosion-resistant material.

9. The wellbore cleanout tool of claim 1, wherein some or all of the plurality of rotor vanes is clad with an erosion-resistant material.

10. A method, comprising:

introducing a work string into a wellbore, the work string including a flow-activated motor having a housing and a driveshaft rotatably positioned within the housing and a rotating agitator tool coupled to the driveshaft such that rotation of the driveshaft correspondingly rotates the rotating agitator tool, the driveshaft being coupled to a plurality of rotor vanes;

pumping a fluid into an annulus defined between the work string and the wellbore with a pump;

receiving at least some of the fluid through one or more bullnose ports defined in the housing and into an interior of the housing, the one or more bullnose ports being positioned axially between the rotating agitator tool and the plurality of rotor vanes;

receiving at least some of the fluid through one or more nozzle ports defined in the rotating agitator tool, through a fluid conduit defined in the driveshaft, and into the interior of the housing, the fluid conduit extending to a portion of the driveshaft that is axially between the one or more bullnose ports and the plurality of rotor vanes;

impinging the fluid on the plurality of rotor vanes and thereby rotating the driveshaft;

rotating the rotating agitator tool and thereby engaging and loosening debris in the wellbore; and entraining the debris in the fluid and flowing the debris through the flow-activated motor with the fluid.

11. The method of claim 10, wherein impinging the fluid on the plurality of rotor vanes comprises impinging the fluid on a plurality of stages axially offset from each other along the driveshaft, wherein each stage includes rotor vanes arranged circumferentially about the driveshaft.

12. The method of claim 10, further comprising:

discharging the fluid and the debris entrained in the fluid from the flow-activated motor and into the work string; and conveying the fluid and the debris entrained in the fluid within the work string to a surface location.

13. The method of claim 10, further comprising altering at least one of the geometry, the size, and the number of the plurality of rotor vanes to optimize operation of the flow-activated motor.

14. A well system, comprising:

a work string extendable into a wellbore;

a pump that pumps a fluid into an annulus defined between the work string and the wellbore;

a flow-activated motor coupled to the work string and having a housing that receives the fluid pumped into the annulus, the flow-activated motor further including a driveshaft rotatably positioned within an interior of the housing and a plurality of rotor vanes coupled to the driveshaft, wherein the driveshaft rotates as the fluid flows through the housing and impinges on the plurality of rotor vanes;

a rotating agitator tool coupled to the driveshaft such that rotation of the driveshaft correspondingly rotates the rotating agitator tool, wherein the rotating agitator tool engages and loosens debris in the wellbore while rotating and the debris is entrained in the fluid and flows through the flow-activated motor;

one or more bullnose ports defined in the housing to receive at least some of the fluid into the interior of the housing, the one or more bullnose ports being positioned axially between the rotating agitator tool and the plurality of rotor vanes;

one or more nozzle ports defined in the rotating agitator tool to receive at least some of the fluid; and a fluid conduit defined in the driveshaft to conduct the fluid from the one or more nozzle ports to the interior of the housing, the fluid conduit extending to a portion of the driveshaft that is axially between the one or more bullnose ports and the plurality of rotor vanes.

15. The well system of claim 14, wherein the work string comprises one of drill pipe lengths connected end to end or coiled tubing.

16. The well system of claim 14, further comprising a central conduit defined in the rotating agitator tool that fluidly communicates with the one or more nozzle ports, wherein the fluid enters the housing by flowing through the one or more nozzle ports, the central conduit, and the fluid conduit.

* * * * *